US007227502B2

(12) United States Patent
Yamamoto

(10) Patent No.: US 7,227,502 B2
(45) Date of Patent: Jun. 5, 2007

(54) PATCH ANTENNA WHOSE DIRECTIVITY IS SHIFTED TO A PARTICULAR DIRECTION, AND A MODULE INTEGRATED WITH THE PATCH ANTENNA

(75) Inventor: Shinji Yamamoto, Osaka (JP)

(73) Assignee: Matsushita Electric Industrial Co., Ltd., Osaka (JP)

( * ) Notice: Subject to any disclaimer, the term of this patent is extended or adjusted under 35 U.S.C. 154(b) by 0 days.

(21) Appl. No.: 11/014,240

(22) Filed: Dec. 17, 2004

(65) Prior Publication Data

US 2005/0179595 A1 Aug. 18, 2005

(30) Foreign Application Priority Data

Dec. 18, 2003 (JP) ..... 2003-420651

(51) Int. Cl.
*H01Q 1/38* (2006.01)

(52) U.S. Cl. ..... 343/700 MS; 343/846

(58) Field of Classification Search ..... 343/700 MS, 343/846

See application file for complete search history.

(56) References Cited

U.S. PATENT DOCUMENTS 4,571,592 A * 2/1986 Justice ..... 343/767
5,376,942 A * 12/1994 Shiga ..... 343/700 MS
6,850,192 B2 * 2/2005 Yeh ..... 343/700 MS
2002/0140609 A1 * 10/2002 Aoki et al. ..... 343/700 MS
2002/0175669 A1 * 11/2002 Ziegner et al. ..... 324/95
2003/0147197 A1 * 8/2003 Uriu et al. ..... 361/311
2006/0256018 A1 * 11/2006 Soler Castany et al. .... 343/700 MS

FOREIGN PATENT DOCUMENTS

JP 5-183328 A 7/1993
JP 5-347509 A 12/1993
JP 09-172321 6/1997
JP 2000-278028 A 10/2000
JP 2000-341026 12/2000
JP 2001-094336 4/2001
JP 2001-196840 A 7/2001

* cited by examiner

*Primary Examiner*—Alford Kindred
*Assistant Examiner*—Angela M Lie
(74) *Attorney, Agent, or Firm*—McDermott Will & Emery LLP

(57) ABSTRACT

A patch antenna with a directivity includes: a dielectric substrate to which at least one through hole is provided; a first ground electrode at least partially covering a back surface of the dielectric substrate; an antenna electrode partially covering an area of a front surface of the dielectric substrate, the area positionally corresponding to the first ground electrode; a second ground electrode provided within the area in a vicinity of the antenna electrode, the second ground electrode having the through hole underneath; and a conductive material provided in the through hole so as to electrically connect the first ground electrode and the second ground electrode.

4 Claims, 8 Drawing Sheets

PATCH ANTENNA WHOSE DIRECTIVITY IS SHIFTED TO A PARTICULAR DIRECTION, AND A MODULE INTEGRATED WITH THE PATCH ANTENNA

BACKGROUND OF THE INVENTION

1. Field of the Invention

The present invention relates to a patch antenna, and particularly to a technology for shifting the directivity of a patch antenna.

2. Description of Background Art

Recently, patch antennas, which are compact and slim circular polarization antennas, are commercially available. FIG. 7 shows a conventional example of such patch antennas. The conventional example has a main body 1000, where a conductive ground electrode 1002 is formed on an entire back surface of a rectangular dielectric substrate 1001, and a conductive antenna electrode 1003 is formed in the center of the front surface of the dielectric substrate 1001. This type of patch antenna is disclosed by Japanese Laid-open patent application No. 2002-11367, for example.

In this prior art, two modes different in phase by 90 degrees are driven by: supply of a high-frequency signal power to the antenna electrode 1003; and grounding of the ground electrode 1002, thereby emitting circular polarization waves. The supply path of high-frequency signal power is a coaxial cable, for example.

There is an array antenna in which a plurality of the aforesaid patch antenna, arranged in lines, are provided as a compact and slim vertical polarization antenna. There is a prior art in which one patch antenna, being one element of such an array antenna, has a main body 1010 whose both ends of a ground electrode 1004 are extended and bent to form bent portions 1002*a*, as FIG. 8 shows. The bent portion 1002*a* has an object of preventing electromagnetic wave interference among the patch antennas. This type of patch antenna is disclosed by Japanese Laid-open patent application No. H09-172321, for example.

In another prior art, in a multiple-layer circuit board, only the top layer is formed to have the same structure as the main body 1000 of the aforesaid patch antenna. Japanese Laid-open patent application No. 2001-94336, for example, discloses that the patch antenna and the circuit board are formed into an integral body.

With all the above-mentioned patch antennas, the orthogonal direction to the main surface of the antenna electrode corresponds to a direction in which the antenna advantage is the largest. In other words, the above-mentioned patch antennas have the directivity in the direction orthogonal to the main surface of the antenna electrode.

An apparatus to which such a patch antenna is applied is a vehicle-mounted GPS (global positioning system), which obtains the position of the vehicle using the radio waves received from a plurality of satellites.

Usually, a patch antenna used for such a vehicle-mounted GPS is set on a place parallel to the earth, such as on a flat dashboard of a vehicle.

In such a case, the directivity of the patch antenna will be substantially immediately above the vehicle, which is desirable for receiving the radio waves from a satellite traveling 20,000 kilometers above from the earth.

Another example of the apparatus to which the patch antenna is applied is an ETC (electronic toll collection) apparatus also used by being mounted in a vehicle and performing transmission/reception of information to/from an external device.

Usually, just as in the case of the vehicle-mounted GPS, such a vehicle-mounted ETC apparatus is equipped with a patch antenna, and the setting place of the patch antenna is also on a dashboard of the vehicle.

However, prior to passing a tollgate, the ETC apparatus performs wireless communication with a road antenna provided at 5 meters height in the vicinity of the tollgate. This means that an ETC apparatus has to perform transmission/reception of information with a road antenna deviated from the directivity of its patch antenna, and so has a problem of having less antenna advantages than originally intended, as well as having reduced transmission/reception performance in the intended direction.

One means to solve this problem is to incline the attitude of the patch antenna toward the front, thereby bringing the actual directivity closer to the intended transmission/reception direction.

Although being an inexpensive means, this causes another problem, as a tradeoff, that the height of the ETC apparatus becomes large because of the inclining of the patch antenna, which leads to reduction of compactness and slimness of the ETC apparatus.

SUMMARY OF THE INVENTION

The present invention has been conceived in view of the above-described problems, and has the first object of providing a patch antenna operable to shift the antenna directivity without inclining the patch antenna nor incurring a large cost increase.

The second object of the present invention is to provide a patch-antenna integrated module into which integrated are: a patch antenna operable to shift the directivity of its antenna without inclining the patch antenna nor incurring a large cost increase; and another substrate.

So as to achieve the first object stated above, the present invention is a patch antenna with a directivity, including: a dielectric substrate to which at least one through hole is provided; a first ground electrode (i.e. a conventional ground electrode) at least partially covering a back surface of the dielectric substrate; an antenna electrode partially covering an area of a front surface of the dielectric substrate, the area positionally corresponding to the first ground electrode; a second ground electrode (i.e. an assistant ground electrode) provided within the area in a vicinity of the antenna electrode, the second ground electrode having the through hole underneath; and a conductive material provided in the through hole so as to electrically connect the first ground electrode and the second ground electrode . . . (Structure 1)

With the structure 1, because of having the conductive material within the through hole, the second ground electrode has the same potential as the first ground electrode. Furthermore, because the second ground electrode is placed in a vicinity of the antenna electrode, the electromagnetic-shielding performance changes depending on position, thereby deflecting the direction in which the electromagnetic waves are outputted towards the direction opposite to the direction in which the second ground electrode is provided.

This means that the directivity is shifted toward the aforementioned deflection direction, from the orthogonal direction to the main surface of the antenna electrode.

Furthermore, in the patch antenna of the structure 1, it is preferable that the directivity is set towards a first direction with reference to the substantial center of the antenna electrode, and the second ground electrode is provided in a second direction that is opposite to the first direction with reference to the substantial center of the antenna electrode . . . (Structure 2).

With the structure 2, the direction of the set directivity is made to coincide with the actual directivity.

Furthermore, in the patch antenna of the structure 2, it is preferable that the second ground electrode is formed as a strip whose lengthwise direction is orthogonal to the first direction . . . (Structure 3).

With the structure 3, seen from the center of the antenna electrode, an electromagnetic wave shield is created wider in the direction opposite to the direction to which the directivity is desired to be shifted. Therefore electromagnetic waves are facilitated to be shifted towards the intended direction, thereby effectively setting the directivity to the desired direction.

Moreover, in the patch antenna of the structure 3, it is possible that the through hole is formed as a slit whose opening's lengthwise direction substantially coincides with the lengthwise direction of the second ground electrode . . . (Structure 4).

With the structure 4, electromagnetic-wave shielding performance is enhanced in the dielectric substrate sandwiched between the second ground electrode and the first ground electrode, thereby effectively shifting the directivity to the intended direction from the direction orthogonal to the antenna electrode's main surface.

In the patch antenna of the structure 3, it is possible that a number of the through hole is plural, and an arrangement direction of the plurality of through holes substantially coincides with the lengthwise direction of the second ground electrode, and an interval between two adjacent through holes is $\lambda/2$ or smaller, where $\lambda$ is a wavelength of electromagnetic waves within the dielectric substrate, the electromagnetic waves being emitted from the antenna electrode . . . (Structure 5).

With the structure 5, electromagnetic waves are prevented from being leaked from among the through holes within the dielectric substrate, thereby enhancing the electromagnetic-wave shielding performance. Accordingly, it becomes possible to effectively shift the directivity from the orthogonal direction to the antenna electrode's main surface, towards the intended direction.

Furthermore, so as to achieve the second object stated above, the patch-antenna integrated module of the present invention includes: a patch antenna including a dielectric substrate to which at least one first through hole is provided, a first ground electrode at least partially covering a back surface of the dielectric substrate, an antenna electrode partially covering an area of a front surface of the dielectric substrate, the area positionally corresponding to the first ground electrode, a second ground electrode provided within the area in a vicinity of the antenna electrode, the second ground electrode having the through hole underneath, and a conductive material provided in the first through hole so as to electrically connect the first ground electrode and the second ground electrode; and a substrate being provided with a second through hole and stacked to the back surface of the dielectric substrate of the patch antenna, the second through hole having inserted therein a semiconductor chip for inputting/outputting power to the patch antenna, where the semiconductor chip, the antenna electrode, and at least one of the first ground electrode and the second ground electrode are connected by means of a conductive material provided in the second through hole provided for the substrate.

With the stated structure, the second ground electrode has the same potential as the first ground electrode, because of the existence of the conductive material. In addition, because the second ground electrode is positioned in the vicinity of the antenna electrode, the electromagnetic-wave shielding performance changes depending on position. Accordingly, the output direction of the electromagnetic waves is deflected to the direction opposite to the direction in which the second ground electrode is provided. In other words, the directivity is shifted to the aforementioned deflected direction from the orthogonal direction to the antenna electrode's main surface.

Furthermore, the power-supply path to the antenna electrode is able to be shortened, thereby reducing noise effect from outside as well as reducing power loss.

BRIEF DESCRIPTION OF THE DRAWINGS

These and other objects, advantages and features of the invention will become apparent from the following description thereof taken in conjunction with the accompanying drawings which illustrate a specific embodiment of the invention. In the drawings.

DESCRIPTION OF THE PREFERRED EMBODIMENTS

Embodiment (1. Structure)

Figure 1:
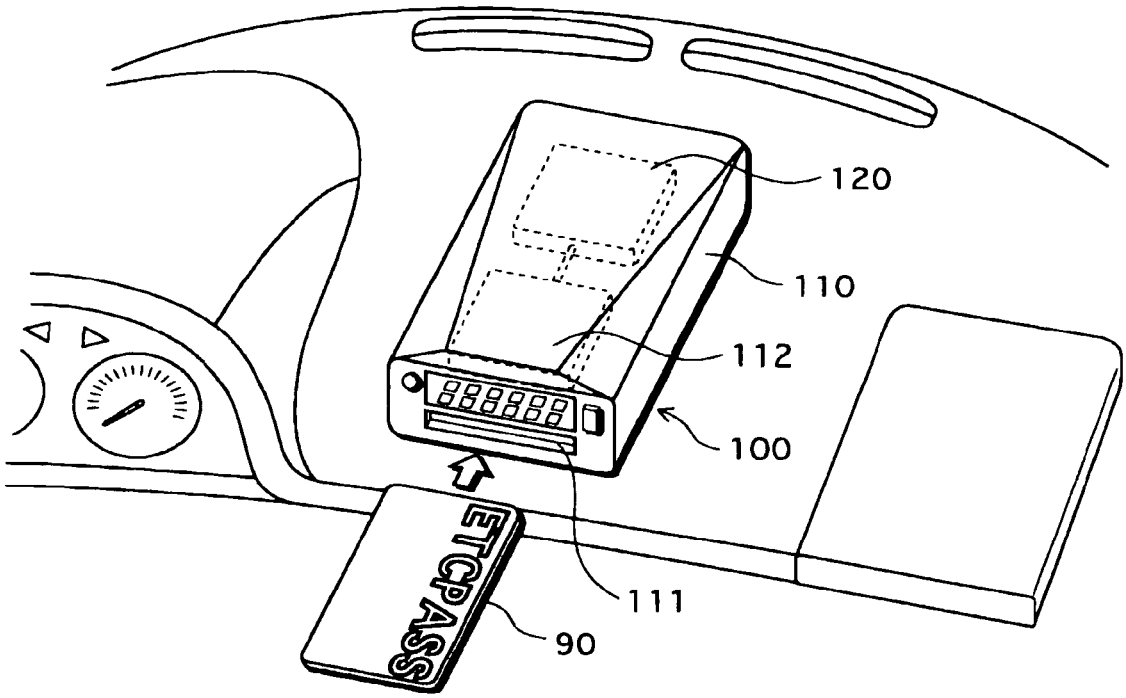
FIG. 1 is a diagrammatic sketch of a vehicle-mounted ETC apparatus in which a patch antenna according to the present invention is incorporated.

FIG. 1 is a diagrammatic sketch of a vehicle-mounted ETC apparatus in which a patch antenna according to the present invention is incorporated.

This ETC apparatus 100, being mounted to a vehicle, performs wireless communication with a road antenna 500 set at a tollgate, and automatically pays a fee for the toll road.

The structure of the ETC apparatus 100 is such that, in an ETC main-body unit 110, a patch antenna unit 120 and a control unit 112 are connected to each other via metal wires and print wiring, the control unit 112 being for controlling the patch antenna.

Note that in using this ETC apparatus 100, it is necessary to first make the apparatus effective by inserting an ETC pass 90 to a pass insertion slit 111 provided for the ETC main-body unit 110.

The following details the ETC apparatus 100.

Figure 2:
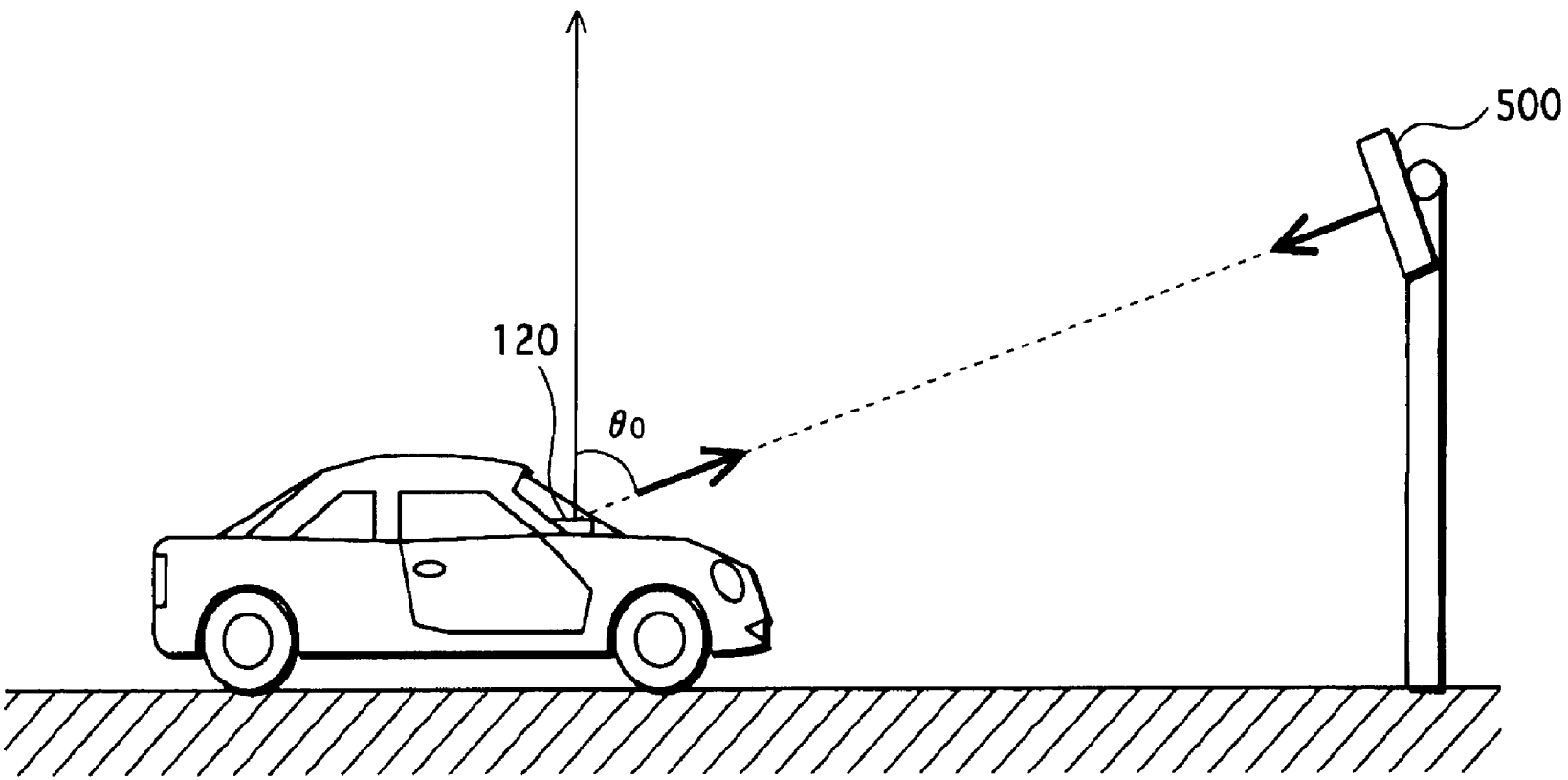
FIG. 2 is a diagram showing transmission/reception states of radio waves at the patch antenna unit 120.

FIG. 2 is a diagram showing transmission/reception states of radio waves at the patch antenna unit 120.

The ETC apparatus 100 is for use by being placed on a dashboard of a vehicle, and the patch antenna unit 120 is a flat antenna for frequency of 5.8 GHz.

When the dashboard is assumed to be substantially horizontal, the road antenna 500, being a communication destination, is oriented at an angle of $\theta_0$ degrees with respect to the plumb line.

Figure 3:
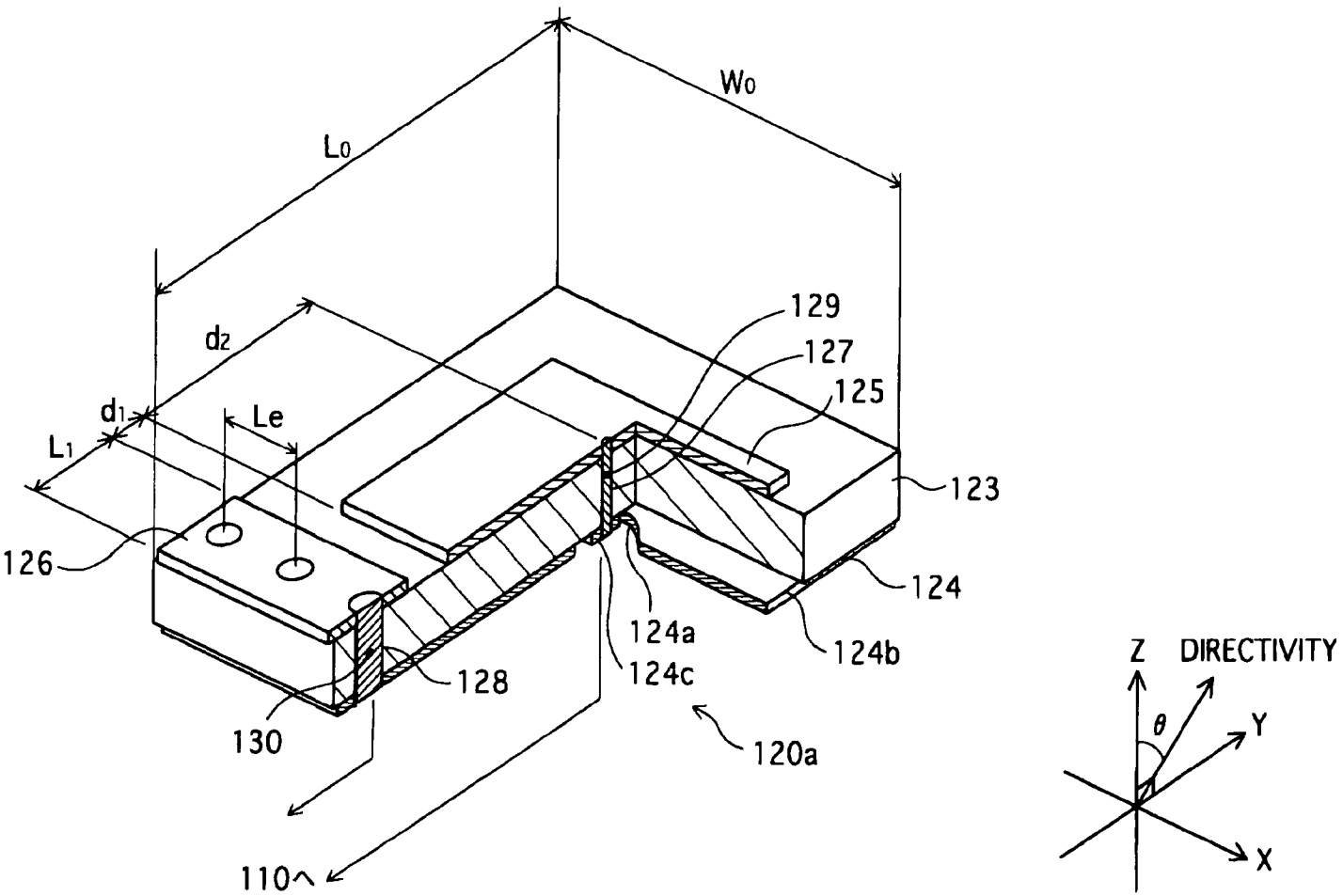
FIG. 3 is a partially sectional perspective diagram showing the structure of the patch antenna main-body unit installed in the patch antenna unit.

FIG. 3 is a partially sectional perspective diagram showing the structure of the patch antenna main-body unit 120*a* installed in the patch antenna unit 120.

The patch antenna main-body unit 120*a* has the following structure. A rectangular-shaped dielectric substrate 123 is provided with a first ground electrode 124*b* on a substantially entire back surface. In the substantial center of the front surface of the dielectric substrate 123, a rectangular-shaped antenna electrode 125 is formed. Also on the front surface of the dielectric substrate 123 along one of the four sides of the rectangle, a second ground electrode 126 in rectangular shape is formed. The antenna electrode 125 is connected, via a plug 129, with a power-supply electrode 124*c* provided on the back surface (the power-supply electrode 124*c* being detailed later). Furthermore, the first ground electrode 124*b* and the second ground electrode 126 are connected, via a plurality of plugs 130 being one example of conductive material.

The dielectric substrate 123 is, for example, a plate of a dielectric constant of 4.6, and is provided with a through hole 127 and through holes 128.

The through hole 127 continues to the power-supply electrode 124*c* and to the antenna electrode 125. Likewise, the through holes 128 continue to the first ground electrode 124*b* and to the second ground electrode 126.

The first ground electrode 124*b* is a copper foil, and covers a substantially entire back surface of the dielectric substrate 123.

The first ground electrode 124*b* is connected to a transmission/reception circuit (not shown) in the ETC main-body unit 110, and is grounded.

The substantial center of the first ground electrode 124*b* is etched, for example, in ring shape to remove the part of the copper foil, thereby forming a removal area 124*a*. At the center of the removal area 124*a*, the power-supply electrode 124*c* is provided by being potentially isolated from the first ground electrode 124*b*.

The antenna electrode 125 is made of a copper foil, and covers the substantial center of the front surface of the dielectric substrate 123.

The transmission/reception circuit in the control unit 112 of the ETC main-body unit 110 is set to be driven at frequency of 5.8 GHz.

Therefore in reception, the antenna electrode 125 converts components of an incident electromagnetic wave that have frequency of about 5.8 GHz, into electric signals. In transmission, the antenna electrode 125 transmits an electric signal having frequency of about 5.8 GHz and having been modulated.

The second ground electrode 126 is made of a copper foil, and is arranged so that its lengthwise direction corresponds to one of the short sides of the rectangle-shaped front surface of the dielectric substrate 123. Note that the second ground electrode 126 may alternatively be formed on two or three adjacent sides of the rectangle-shaped front surface of the dielectric substrate 123.

The power-supply electrode 124*c* is connected to the transmission/reception circuit in the ETC main-body unit 110.

The plug 129 is made of a conductive material, and is provided in the through hole 127 provided between the power-supply electrode 124*c* and the antenna electrode 125.

The plugs 130 are made of a conductive material, and are respectively provided through the through holes 128 provided in an area of the dielectric substrate 123, the area being sandwiched between the second ground electrode 126 and the first ground electrode 124*b*, the through holes 128 being provided along the second ground electrode 126 at a constant interval.

As FIG. 3 shows, if assumption is made that an interval between two adjacent plugs 130 is "Le", then $Le \leqq \lambda'/2$, where $\lambda'$ is the wavelength of the electromagnetic wave within the dielectric substrate.

(Reason for Providing the Second Ground Electrode)

Because of being grounded, the first ground electrode 124*b* and the second ground electrode 126 interfere electromagnetic waves. Therefore, electromagnetic waves emitted from the antenna electrode 125 attempt to travel by avoiding the first ground electrode 124*b* and the second ground electrode 126.

Accordingly, in a structure without the second ground electrode 126 (e.g. the main body 1000 in the conventional patch antenna), electromagnetic waves emitted from the antenna electrode 125 travel in the direction orthogonal to the main surface of the antenna electrode 125 and that from the back surface to the front surface of the dielectric substrate 123 (hereinafter the this direction being referred to as "standard direction"). When the second ground electrode 126 is added to this structure, the traveling direction of the electromagnetic waves will be deflected towards a side having relatively inferior electromagnetic-wave shielding performance (i.e. opposite side to where the second ground electrode 126 is positioned)

This tendency is not limited to the electromagnetic waves emitted from the antenna electrode 125, and also applies to the electromagnetic waves received by the antenna electrode 125.

The object of providing the second ground electrode 126 is to shift the gradient of the antenna directivity from the standard direction to the intended direction.

(Reason for Interval between the Plugs 130)

The following describes the reason why "Le" is set to satisfy $Le \leqq \lambda'/2$.

An electromagnetic wave simulation is performed, assuming the parameters as the interval "Le" between adjacent plugs 130, and the wavelength "$\lambda'$" of the electromagnetic waves within the dielectric substrate. The result shows that, when the condition $Le \leqq \lambda'/2$ is satisfied, an electromagnetic-wave shielding effect sufficient for interfering electromagnetic waves having frequency of $1/\lambda'$ is obtainable in the area of the x-z plane crossing over the plugs 130 (hereinafter this plane being referred to as "plug-array formed area").

Furthermore, the simulation result shows that as the numeric value of "Le" becomes small, higher electromagnetic-wave shielding effect is obtained.

When the condition $Le \leqq \lambda'/2$ is satisfied, the first ground electrode 124*b* is also considered to exist in the dielectric substrate 123 between the plugs 130. Therefore in this case, the first ground electrode 124*b*, the second ground electrode 126, and the plug-array formed area are considered to function as one integrated ground electrode.

The reason why the interval "Le" between adjacent plugs 130 is set to satisfy $Le \leqq \lambda'/2$ is to restrain leak of the electromagnetic waves through the plug-array formed area, and to largely shift the gradient of the antenna directivity from the standard direction.

(Parameters Relating to Adjustment of the Angle θ and Concrete Numeric Values Thereof)

(1) Numeric Values of "Le"

The concrete numeric value of "Le" is set as follows.

The relation between frequency f (Hz) and a wave length λ(m) is represented by the expression 1, using the electromagnetic wave speed c(m/sec) within the vacuum state.

$$\lambda = c/f \qquad \text{<expression 1>}$$

In addition, the wavelength reduction rate within the dielectric substrate 123 is represented by the following expression 2, using a dielectric constant "∈r" of the dielectric substrate 123.

$$\text{wavelength reduction rate} = 1/\sqrt{(\in r)} \qquad \text{<expression 2>}$$

From the above, the wavelength of electromagnetic waves within the dielectric substrate λ' (m) is represented by the following expression 3.

$$\lambda' = c/(f * \sqrt{(\in r)}) \qquad \text{<expression 3>}$$

Since the dielectric constant "∈r" for the dielectric substrate 123 is 4.6, the frequency "f" for an ETC apparatus is 5.8 GHz, and the speed "c" of electromagnetic waves in a vacuum is $3*10^8$ m/sec, the relation represented in the expression 4 holds.

$$\lambda' = 3*10^8/(5.8*10^9*\sqrt{(4.6)}) = 0.025(m) = 25(mm) \qquad \text{<expression 4>}$$

Here, because $Le \leqq \lambda'/2 = 12.5$, "Le" is set to be 12.5 mm or smaller.

An angle θ, which is formed by the above-described directivity direction and the orthogonal direction to the main surface of the antenna electrode 125, is set close to the angle $\theta_0$ as much as possible.

According to the above-described structure, high antenna advantage is assured in transmission/reception in the direction shifted from the direction vertical to the main surface of the patch antenna.

(2. Manufacturing Method)

The patch antenna main-body unit 120*a* is manufactured using the same method in which normal multi-layer print substrates are manufactured.

More specifically, a dielectric substrate 123 whose both main surfaces are provided with a copper foil, is prepared. To the both main surfaces, firstly masking is provided in an intended pattern. Secondly, etching processing is performed, thereby removing the copper foil of where there is no masking provided. According to the described method, the first ground electrode 124*b*, the power-supply electrode 124*c*, the second ground electrode 126, and the antenna electrode 125 are formed at the same time.

Furthermore, so as to connect the different layers, a so-called through-hole technology is applied.

This through-hole technology is specified as follows. The through holes 128 and the through hole 127 are created through the dielectric substrate in the thickness direction, by milling processing, laser processing, or the like. Then, a conductive material or a conductive paste, or the like is filled in these through holes. The conductive material, the conductive paste, or the like is softened by being heated, and then hardened by being kept at room temperature, thereby completing each conductive path connecting the different layers.

It is alternatively possible to create the conductive path by providing plating on an inner surface of each through hole.

In such a case, the thickness of the plating is preferably set at the skin depth of a conductive path that corresponds to the transmission/reception frequency, or larger, considering a skin effect of concentrating the electric current on the surface of the conductive path as the frequency of transmission/reception signals becomes high.

When such a through-hole technology is used in creating the patch antenna main-body unit 120*a*, the number "n" of through holes is preferably as small as possible, from the viewpoint of cost reduction.

However, it is still necessary to satisfy the interval "Le" constraint for the through holes 128 (i.e. $Le \leqq \lambda'/2$). Therefore from a realistic point of view, "Le" and "n" will converge on values that can achieve both of the target values for the cost reduction and the electromagnetic-wave shielding performance.

In this embodiment, the transmission/reception frequency of the ETC apparatus 100 is 5.8 GHz. However, the frequency is not limited to such and can take any other values.

MODIFICATION EXAMPLE 1

Figure 4:
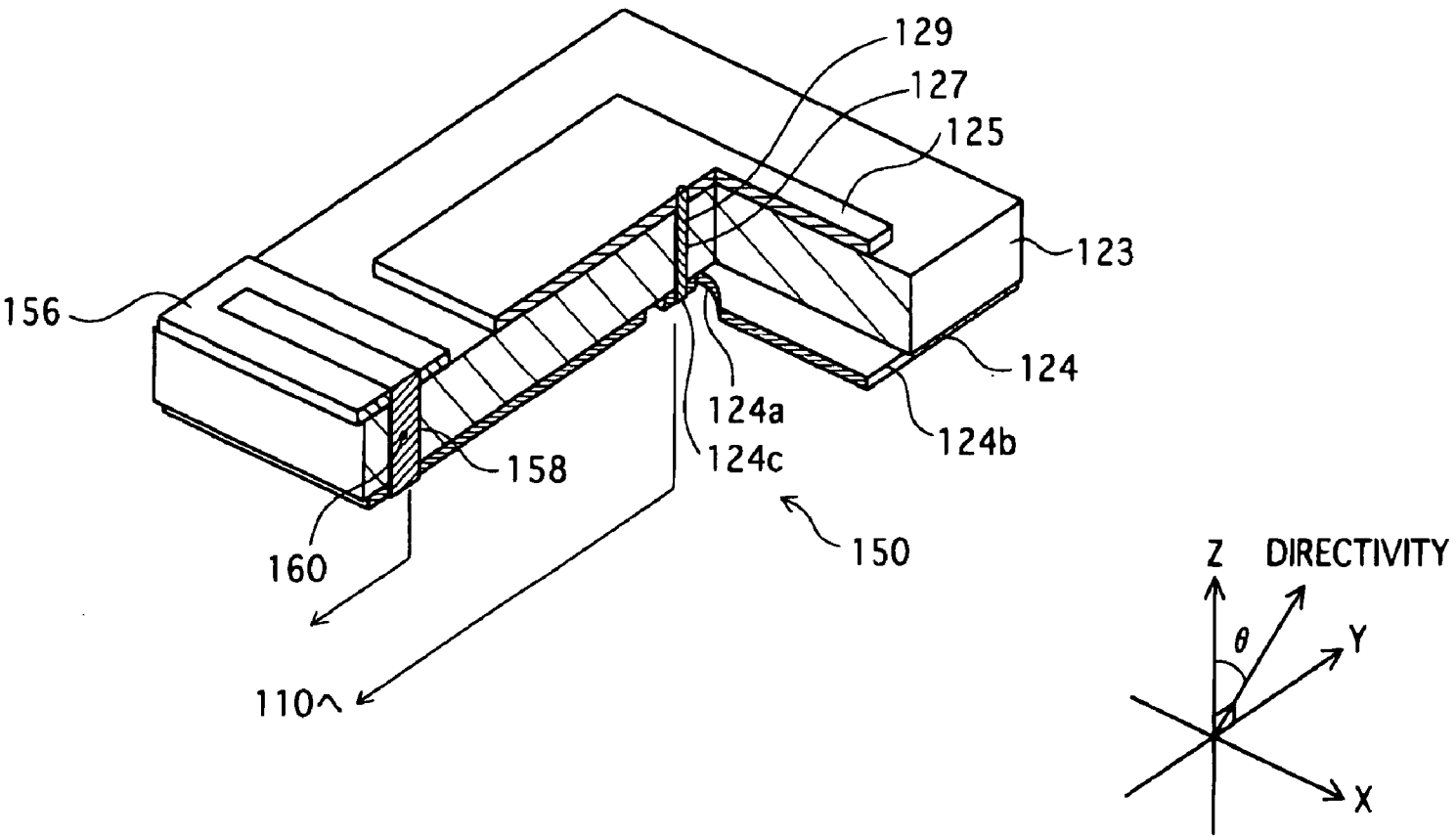
FIG. 4 shows a modification example of the patch antenna of the embodiment of the present invention.

In the above-described embodiment, the through holes 128 are provided in an area sandwiched between the second ground electrode 126 and the first ground electrode 124*b*, at a constant interval along the second ground electrode 126. However, it is alternatively possible to have only one through hole 128. For example, as FIG. 4 shows, one horizontally long through hole may be provided in the area sandwiched between the second ground electrode 126 and the first ground electrode 124*b*, so as to continue to the second ground electrode 126 and the first ground electrode 124*b*.

In this case, a conductive plug 160 may be provided in the horizontally long through hole 158, so as to connect the first ground electrode 124*b* and the second ground electrode 126.

If such a conductive plug is filled in the horizontally long through hole 158, an electric current is prevented from flowing into its core portion due to the already mentioned skin effect. In view of this, instead of filling the plug, it is preferable to provide plating on the inner surface of the through hole 158.

In the embodiment, the cross-sectional form of the through hole adopted is round and horizontally long form. Although being conventionally round, the cross-sectional form of the through hole is not limited to the above-listed forms, and may be in any forms, or a combination of any such forms.

MODIFICATION EXAMPLE 2

Figure 5:
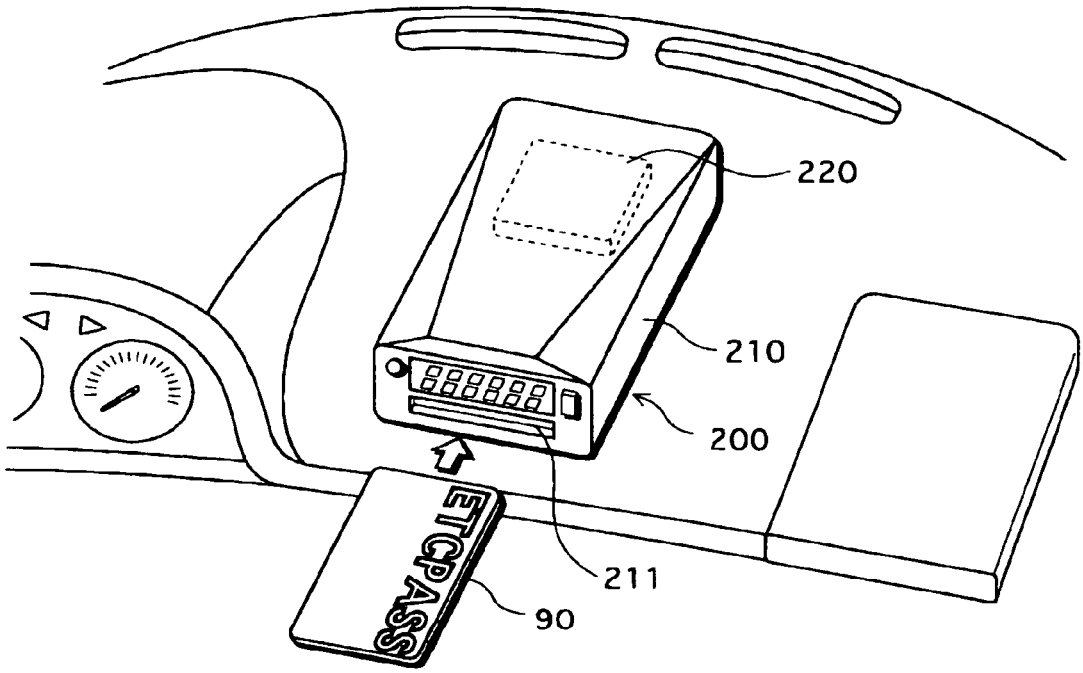
FIG. 5 is a diagrammatic sketch of a vehicle-mounted ETC apparatus with a patch-antenna integrated module.

FIG. 5 is a diagrammatic sketch of a vehicle-mounted ETC apparatus incorporating therein a patch-antenna integrated module in which a patch antenna main-body unit 120*a* is connected to a circuit board within the ETC main-body unit 110.

The ETC apparatus 200, being mounted to a vehicle, performs wireless communication with a road antenna 500 set at a tollgate, and automatically pays a fee for the toll road, just as the ETC apparatus 100 in the embodiment.

The ETC apparatus 200 includes a patch-antenna integrated module 220 within an ETC main-body unit 210.

It should be noted that in using this ETC apparatus 200, it is necessary to first make the apparatus effective by inserting an ETC pass 90 to a pass insertion slit 211, just as with the ETC apparatus 100 of the embodiment.

The following details the patch-antenna integrated module 220.

Figure 6:
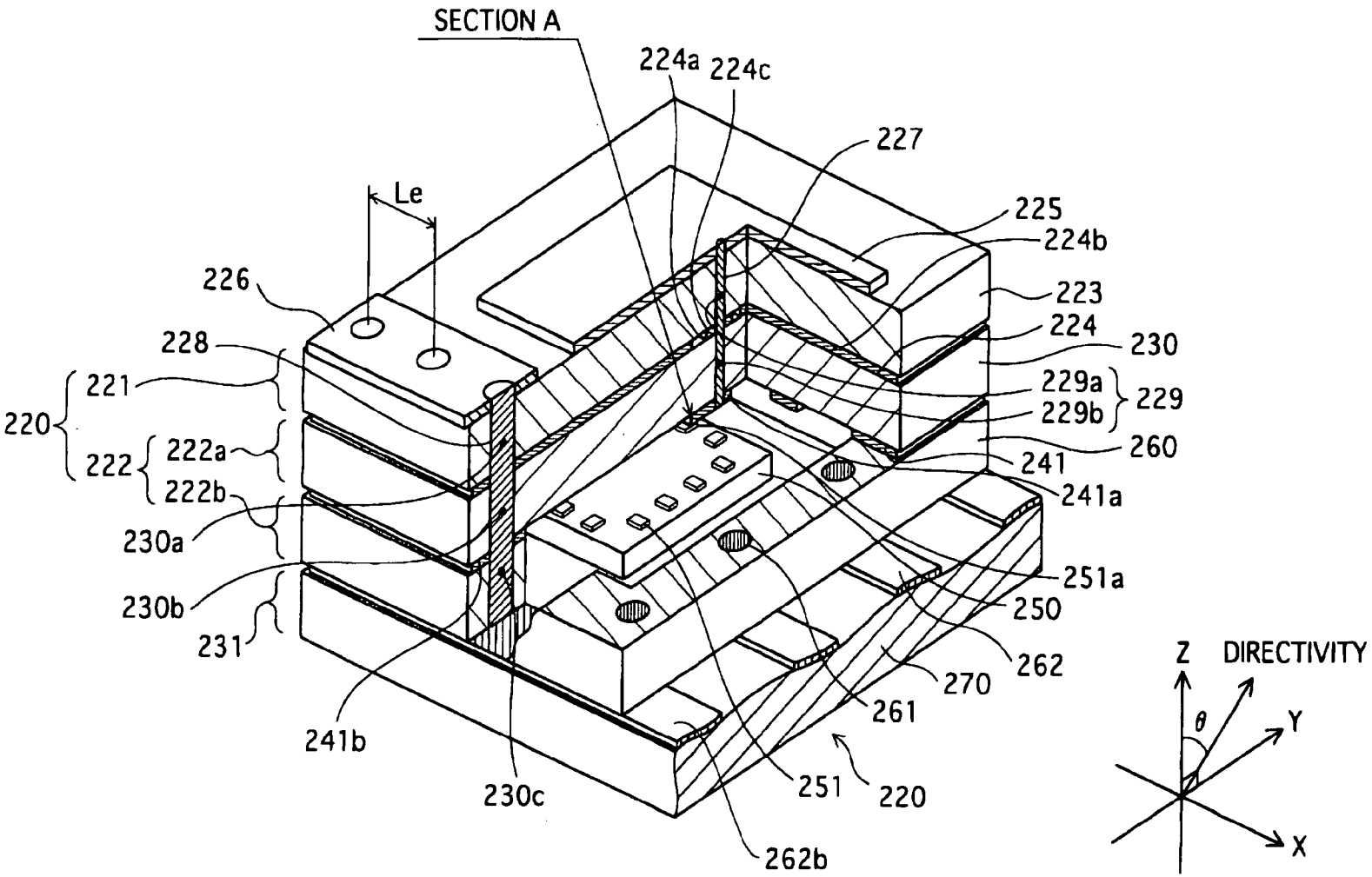
FIG. 6 is a diagrammatic sketch of a vehicle-mounted ETC apparatus in which the patch antenna in the modification example of the embodiment is incorporated.
Figure 7:
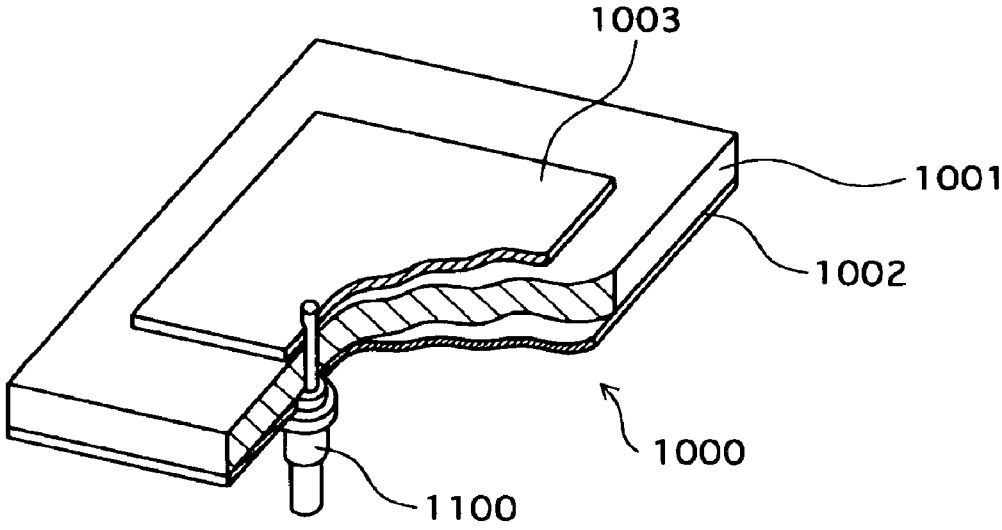
FIG.7 PRIOR ART
FIG. 7 is a partially sectional perspective diagram showing the conventional structure No. 1.
Figure 8:
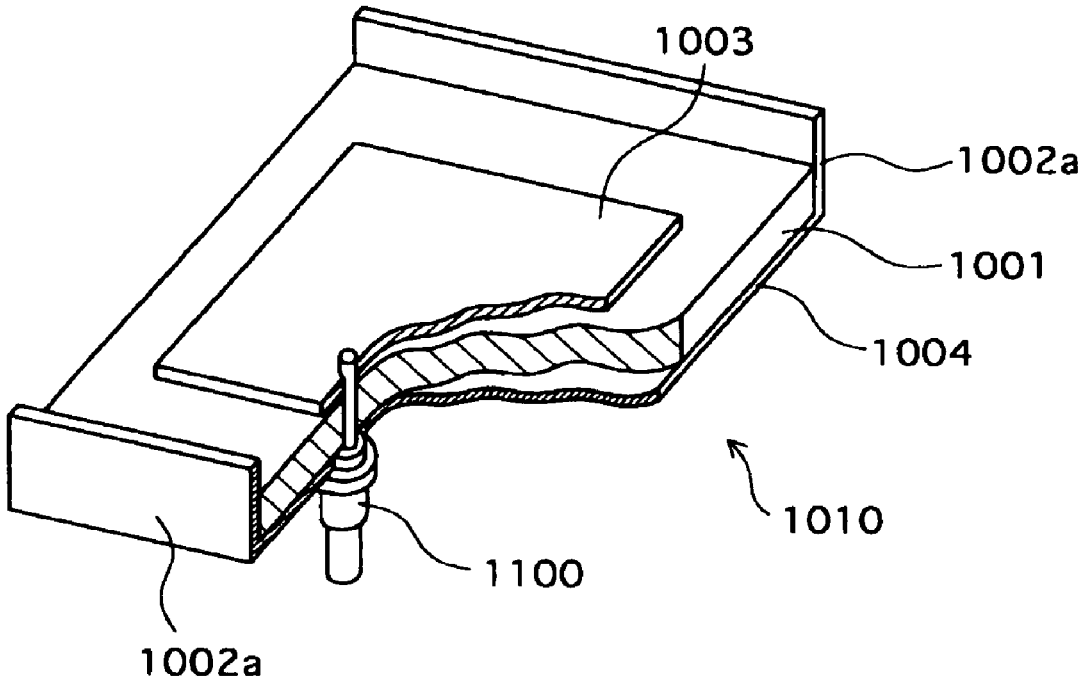
FIG.8 PRIOR ART
FIG. 8 is a partially sectional perspective diagram showing the conventional structure No. 2.

As FIG. 6 shows, the patch-antenna integrated module 220 has such a structure that, on multi-layer print substrate groups 222 to which a semiconductor chip and the like is mounted, a patch antenna main-body unit 221 is further stacked, the patch-antenna main-body unit 221 corresponding to the patch antenna main-body unit 120*a* of the embodiment.

Note that FIG. 6 also shows a set substrate 231 that is a base for all the substrates.

The patch antenna main-body unit 221 is a flat antenna for frequency of 5.8 GHz, and components therein correspond to the components of the patch antenna main-body unit 120*a* described above, in one-to-one relation, and are respectively identical to a corresponding component of the patch antenna man-body unit 120*a*. Therefore explanation on the components in the patch antenna main-body unit 221 is omitted, and only the correspondence is shown as a table below.

TABLE 1

| | Component in patch antenna main-body unit 120 | Component in patch antenna main-body unit 221 |
|---|---|---|
| 1 | Dielectric substrate 123 | Dielectric substrate 223 |
| 2 | Removal area 124a | Removal area 224a |
| 3 | First ground electrode 124b | First ground electrode 224b |
| 4 | Power-supply electrode 124c | Power-supply electrode 224c |
| 5 | Antenna electrode 125 | Antenna electrode 225 |
| 6 | Second ground electrode 126 | Second ground electrode 226 |
| 7 | Through hole 127 | Through hole 227 |
| 8 | Through holes 128 | Through holes 228 |
| 9 | Plug 129 | Plug 229a |
| 10 | Plugs 130 | Plugs 230a |

The multi-layer substrate group 222 is comprised of first substrate 222*a*, a second substrate 222*b*, and a set substrate 231.

The first substrate 222*a* is bonded, in a face-down bonding method, to a back surface of the dielectric substrate 231 on which a wiring pattern group 241 made of a plurality of wiring patterns is formed (i.e. to the lower side of the z-axis in the drawing).

On a periphery of one main surface of a semiconductor chip 250, a ball bump group made of a plurality of ball pumps is provided The semiconductor chip 250 outputs an inputted signal after providing thereto amplification, division, and multiplication.

In the ball bump group 251, a ball bump 251*a* is a signal input/output terminal for antenna electrode.

The dielectric substrate 230 is provided with through holes having a round shape, at positions corresponding to the plug 229*a* and the plugs 230*a*, respectively. The plug 229*b* and the plugs 230*b* are respectively set in the corresponding through holes.

In the wiring pattern group 241, a wiring pattern 241*a* is formed to electrically connect the plug 229*b* and the ball bump 251*a* provided at the section A of the semiconductor chip 250.

The second substrate 222*b* is formed by providing conductive plugs 261 respectively for a plurality of through holes provided through a frame-shaped dielectric substrate 260.

The meaning of the second substrate 222*b* is to form a cavity for accommodating the semiconductor chip 250 in the patch-antenna integrated module 220. The second substrate 222*b* is also for electrically connecting the two different layers: the set substrate 231 and the first substrate 222*a* via the plugs 261.

The set substrate 231 is a substrate that is a base for all the substrates, and is made up of: a dielectric substrate 270; and a predetermined wiring pattern 262 (including a ground wiring pattern 262*b*) formed on a surface of the dielectric substrate 270, the surface facing the second substrate 222*b*. Components (not shown) other than those included in the patch-antenna integrated module 220 are also mounted to the set substrate 231. The second ground electrode 226 on a surface of the patch-antenna main-body unit 221 is connected to the ground wiring pattern 262*b* via the plugs 230*a*, the plugs 230*b*, and the plugs 230*c*.

Note that the plugs 230*a*, the plugs 230*b*, and the plugs 230*c* are different components from each other in the above explanation. However, the present invention is not limited to such a structure; a different structure is also possible in which, for example, the plugs 230*a*, the plugs 230*b*, and the plugs 230*c* are integrated.

Likewise, the plug 229*a* and the plug 229*b* are different components from each other in the above explanation. However, a plug 229 into which the plug 229*a* and the plug 229*b* are integrated may alternatively be provided.

With the patch-antenna integrated module 220 structured as above, signals outputted from the semiconductor chip 250 are inputted to the antenna electrode 225 via the conductive path created in the through hole being short (i.e. via the plug 229*a* and the plug 229*b*), and then are emitted into the air as electromagnetic waves. Therefore, it is no more necessary to provide a long conductive path such as the cable 113, which reduces noise effect from outside as well as reducing power loss.

The patch-antenna integrated module 220 may be manufactured in the same method as the patch antenna unit 120, except that the semiconductor chip 250 is bonded in the face-down bonding method using a bump.

Although the present invention has been fully described byway of examples with reference to accompanying drawings, it is to be noted that various changes and modifications will be apparent to those skilled in the art. Therefore, unless such changes and modifications depart from the scope of the present invention, they should be construed as being included therein.

What is claimed is:

1. A patch-antenna integrated module comprising:

a patch antenna including a dielectric substrate to which at least one first through hole is provided, a first ground electrode at least partially covering a back surface of the dielectric substrate, an antenna electrode partially covering an area of a front surface of the dielectric substrate, the area positionally corresponding to the first ground electrode, a second ground electrode provided within the area in a vicinity of the antenna electrode, the second ground electrode having the through hole underneath, and a conductive material provided in the first through hole so as to electrically connect the first ground electrode and the second ground electrode; and a substrate being provided with a second through hole and stacked to the back surface of the dielectric substrate of the patch antenna, a semiconductor chip for inputting/outputting power to the patch antenna being mounted to the substrate, wherein the semiconductor chip, the antenna electrode, and at least one of the first ground electrode and the second ground electrode are connected by means of a conductive material provided in thesecond through hole provided for the substrate.

2. The patch antenna of claim 1, wherein the second ground electrode is formed in the shape of a rectangle.

3. The patch antenna of claim 2, wherein the through hole is formed as a slit whose opening's lengthwise direction substantially coincides with the lengthwise direction of the second ground electrode.

4. The patch antenna of claim 2, wherein a number of the through hole is plural, and an arrangement direction of the plurality of through holes substantially coincides with the lengthwise direction of the second ground electrode, and an interval between two adjacent through holes is $\lambda/2$ or smaller, where $\lambda$ is a wavelength of electromagnetic waves within the dielectric substrate, the electromagnetic waves being emitted from the antenna electrode.

* * * * *